United States Patent [19]

Siden

[11] 4,049,334

[45] Sept. 20, 1977

[54] WIRE PREPARATION AND TERMINATION MEANS AND METHOD

[75] Inventor: Dennis C. Siden, Portola Valley, Calif.

[73] Assignee: Raychem Corporation, Menlo Park, Calif.

[21] Appl. No.: 653,010

[22] Filed: Jan. 28, 1976

[51] Int. Cl.[2] ..... H01R 9/08

[52] U.S. Cl. ..... 339/97 R; 339/275 B

[58] Field of Search ..... 339/97–99, 339/275

[56] References Cited

U.S. PATENT DOCUMENTS

| | | | |
|---|---|---|---|
| 3,040,150 | 6/1962 | Rueger | 339/97 R |
| 3,614,294 | 10/1971 | LeRouzic et al. | 339/98 |
| 3,634,601 | 1/1972 | Pauza | 339/97 R |
| 3,914,004 | 10/1975 | Bone | 339/97 Rm |

FOREIGN PATENT DOCUMENTS

| | | | |
|---|---|---|---|
| 1,640,630 | 10/1969 | Germany | 339/97 R |
| 2,061,097 | 6/1972 | Germany | 339/97 P |
| 452,634 | 5/1968 | Switzerland | 339/97 R |

*Primary Examiner*—Joseph H. McGlynn

*Attorney, Agent, or Firm*—Lyon & Lyon

[57] ABSTRACT

A device for preparing an insulated conductor and connecting the insulated conductor to a circuit board of the type having termination holes therein. An elongate pin sized to closely fit in the appropriate termination hole is employed to simultaneously cut the insulated conductor to length, strip a portion of the insulation therefrom and position the resulting stripped conductor tightly between the pin and the termination hole. The pin includes an abrupt transverse edge which cooperates with the upper edge of the termination hole to shear an insulated conductor interposed therebetween. Located on the other side of the pin is an elongated channel running longitudinally along the pin. The elongated channel also cooperates with the termination hole to strip the insulation from the trimmed conductor and hold the stripped wire tightly in the channel through the forced insertion of the pin in the appropriate termination hole. A method for preparing and terminating an insulated conductor is also disclosed whereby a pin is used in conjunction with a termination hole on a circuit board to simultaneously prepare and terminate an insulated conductor.

18 Claims, 10 Drawing Figures

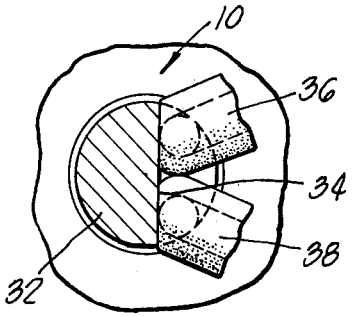
FIG. 5.
FIG. 6.
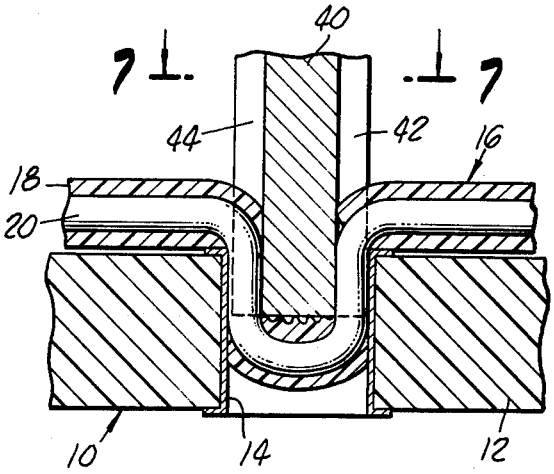
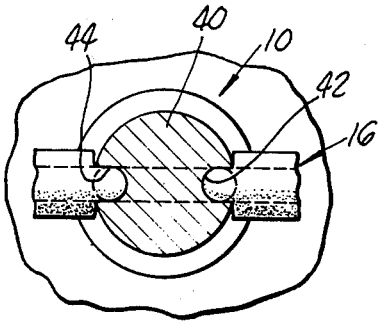
FIG. 7.
FIG. 10.
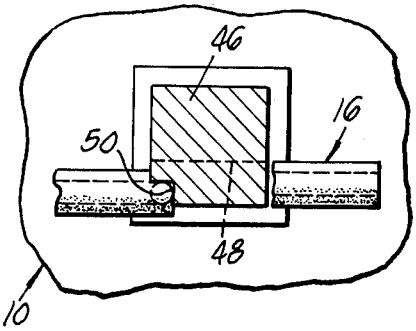
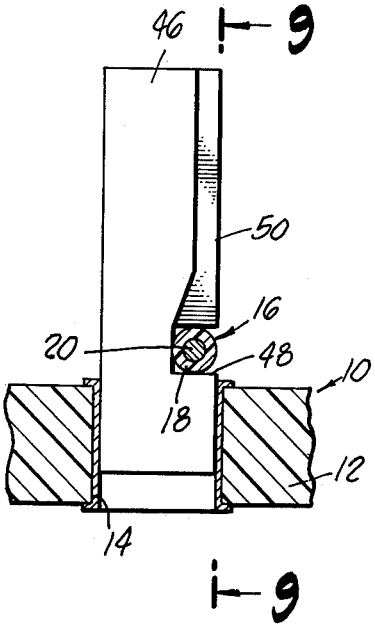
FIG. 8.
FIG. 9.
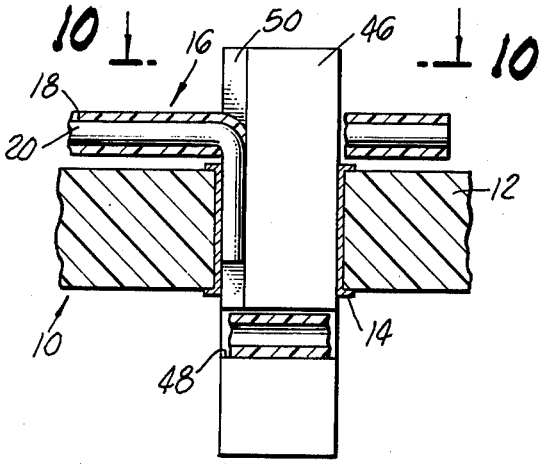

WIRE PREPARATION AND TERMINATION MEANS AND METHOD

BACKGROUND OF THE INVENTION

The present invention is directed to the preparation and termination of insulated conductors. More specifically, the present invention is directed to the simultaneous trimming, stripping and terminating of an insulated conductor for association with a circuit board.

The preparation and termination of insulated conductors for employment with a circuit board has generally been carried out by an exacting, multi-step process requiring substantial operator skill and time. This demanding process when applied to a large number of connections in any given electronic system becomes expensive and may have a substantial probability of termination failure.

Certain systems have been developed for reduciing the complexity and increasing the reliability of such terminations. The systems have generally required a complicated mechanism to take the place of assembly steps. One such system is disclosed in U.S. Pat. No. 3,012,219. See also U.S. Pat. No. 3,916,733 and U.S. patent application Ser. No. 442,580, filed Feb. 14, 1974. However, none of these systems is capable of providing the functions of cutting an insulated conductor to length, stripping a portion of the insulation from the conductor and placing the prepared conductor into the terminating device preparatory to termination. Thus, even though substantial savings can be made through the use of certain presently known automated processes for preparing and terminating wires, a simple and easily operated system for performing all three functions of trimming, stripping and terminating an insulated conductor has not heretofore existed.

SUMMARY OF THE INVENTION

The present invention is directed to a device and method employing a very simple mechanism for trimming, stripping and terminating insulated conductors in one simultaneous operation. As very simple mechanisms and procedures are required by the present invention to fully trim, strip and terminate an insulated conductor with a circuit board, substantial savings can be achieved hand-in-hand with improved reliability. These advantages are magnified when the present invention is employed with relatively complicated electronic systems requiring a large number of such terminations.

The present invention incorporates a pin which closely fits into a receiving hole in a circuit board. The trimming, stripping and termination steps are accomplished by placing an insulated conductor across such a termination hole and forcing a pin down on the insulated conductor and into the hole. The pin may include an abrupt edge extending transversely across a portion of a pin such that a shearing of an insulated conductor between the abrupt edge and the edge of the termination hole will occur upon insertion of the pin. A longitudinally extending channel may also be provided in the pin of the present invention to receive the remainder of the insulated conductor extending across the termination hole. The channels simultaneously severs and strips a portion of the insulation from the conductor and retains the stripped conductor in position between the pin and the wall of the termination hole. Thus, through the simple placement of an insulated conductor and the insertion of a pin into a termination hole in a circuit board, a simple and reliable termination can be achieved employing the present invention.

Accordingly, it is an object of the present invention to provide a mechanism for simultaneously stripping and terminating an insulated conductor.

It is another object of the present invention to provide a means for trimming, stripping and terminating an insulated conductor.

It is a further object of the present invention to provide an improved means for terminating an insulated conductor to a circuit board.

Moreover, it is an object of the present invention to provide an improved method for terminating an insulated conductor to a circuit board.

Other and further objects and advantages will appear hereinafter.

BRIEF DESCRIPTION OF THE DRAWINGS

FIG. 5 is a second embodiment of the present invention illustrating a top view of two insulated conductors terminated by the present invention.

FIG. 6 is yet another embodiment of the present invention illustrated in elevation with an insulated conductor terminated in a circuit board.

FIG. 7 is a cross-sectional plan view taken along line 7—7 of FIG. 6.

FIG. 8 is a further embodiment of the present invention illustrated in elevation with an insulated conductor in position for termination with a circuit board.

FIG. 9 is a cross-sectional elevation taken along line 9—9 of FIG. 8 and with the insulated conductor fully terminated in the circuit board.

FIG. 10 is a sectional plane view taken along line 10—10 of FIG. 9.

DETAILED DESCRIPTION OF THE PREFERRED EMBODIMENTS

Figure 1:
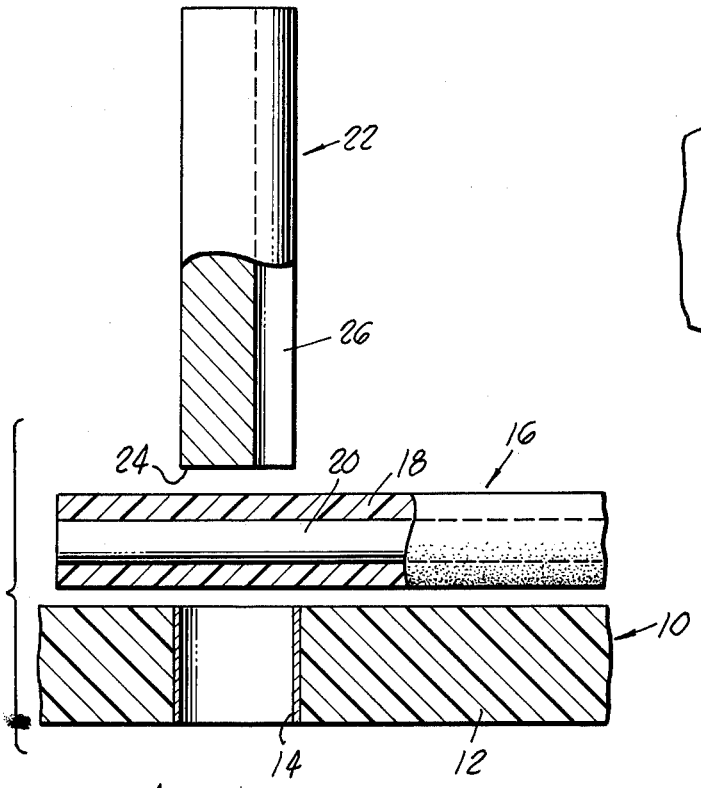
FIG. 1 is an elevation in partial section of an insulated conductor, a circuit board and a pin of the present invention in position for termination.
Figure 4:
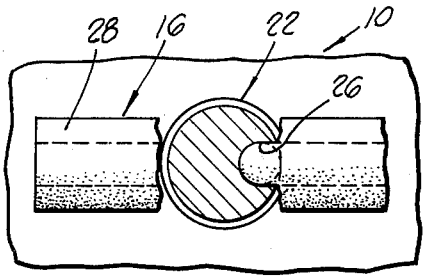
FIG. 4 is a top view of the finally terminated system as seen in FIG. 3.

Turning in detail to the drawings, and particularly the first embodiment illustrated in FIGS. 1 through 4, a substrate with electrical conductors and components attached thereto, generally designated 10, is illustrated as a thin plate 12 including a conductive termination hole 14. The substrate 10 is intended only as an example and a large number of configurations are possible without departing from the inventive concepts of the present invention. These substrates are often termed circuit boards or printed circuit boards and the term "corcuit board" is employed in the present specification as including all substrates to which electrical conductors and components may be attached.

Such substrates may include, for example, multi-termination connectors as well as printed circuit boards, electrical and electronic components and the like to which electrical conductors, electronic leads and the like are to be terminated. The present invention is designed to be employed with termination holes 14 commonly used in circuit board design. The termination holes 14 are also plated through in the embodiment of FIG. 1 such that electrical termination may be achieved at any point within the hole 14. However, any other means by which an electrically conductive path is provided from the interior wall of a termination hole 14 may be employed with equal facility and assurance in the present invention. The plate 12 may, for example, be of conventional paper-base phenolic materials or fiberglass reinforced resin materials or any other suitable circuit board material having a hardness and rigidity at least approaching that of the aforementioned commonly employed materials.

Also illustrated in the embodiments of FIGS. 1 through 4 is an insulated conductor, generally designated 16, of conventional design. The insulated conductor 16 includes a cylindrical case of insulation 18 with a central core of copper wire 20. Naturally, any similar electrical conductor may be used with equal facility in the present invention. The wire 20 is shown to be solid. However, multiple strands may be used.

Figure 2:
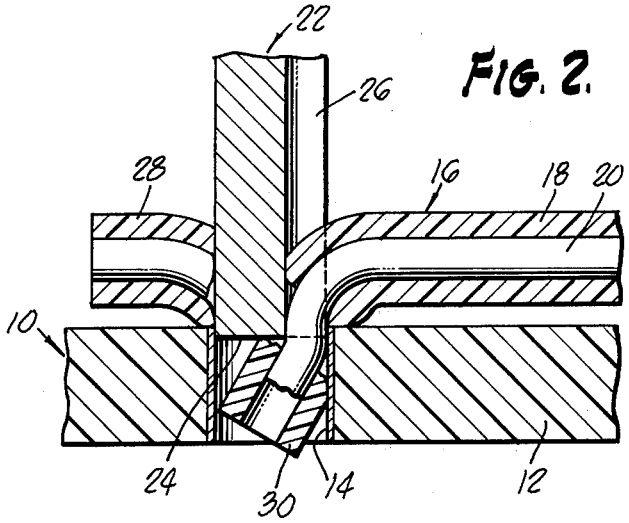
FIG. 2 is an elevation of the embodiment of FIG. 1 with the insulated conductor partially terminated with the circuit board.
Figure 3:
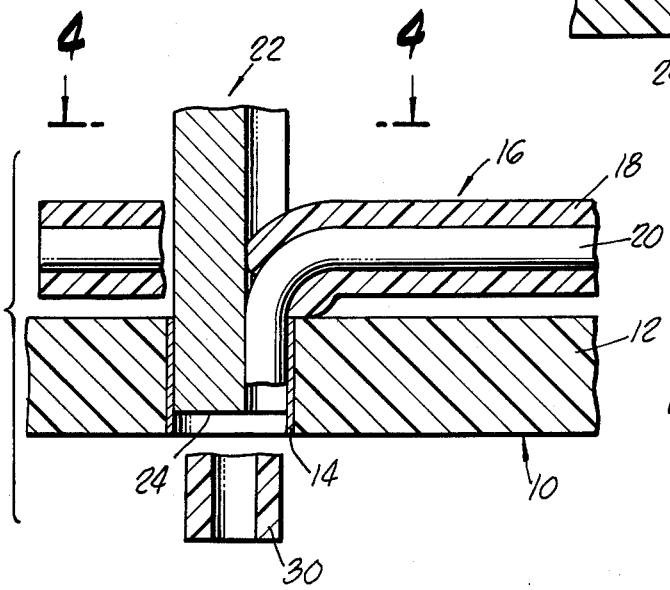
FIG. 3 is an elevation of the embodiment of FIG. 1 with the insulated conductor fully terminated in the circuit board.

A pin, generally designated 22, is illustrated in FIG. 1 in position for assembly, in FIG. 2 as partially assembled and in FIG. 3 as fully assembled with the circuit board 10 and the insulated conductor 16. The pin 22 of an elongate, generally cylindrical in shape closely fits within an appropriate termination hole 14. A slight interference fit between the pin 22 and the termination hole 14 of the circuit board 10 has been found to be preferable to insure retention of the pin 22 after assembly. In the embodiment of FIG. 1, the pin 22 includes a first end 24 substantially perpendicular to the surface of the pin 22. The first end 24 thereby provides an abrupt edge to said pin 22 running transversely across the pin. The abrupt edge thus formed is intended to cooperate with the edge of the termination hole 14 in the circuit board 10 to shear the insulated conductor 16 as a means for trimming the conductor for termination. Alternatively, end 24 may have a bevel wedge chisel or chamfered configuration which tends to reduce the tendency of the conductor 16 to elongate.

The pin 22 further includes longitudinally extending channel 26 running the length of the pin 22. The longitudinally extending channel 26 is on the opposite side of the pin 22 from what may be defined as the operative portion of the abrupt edge formed at the intersection of the end 24 with the side of the pin 22. The channel 26 is conveniently rounded at the innermost portion thereof, has a maximum depth which is substantially equal to the width thereof and forms an abrupt edge with end 24 to facilitate cutting of the insulation. The channel 26 is also sized to accommodate only the wire 20 of the insulated conductor 16 such that the insulation 18 will be stripped from the wire 20 as will be more fully discussed below. The size of the longitudinally extending channel 26 is also designed such that there will be an interference fit with the wire 20 positioned therein. This enables retention of the wire 20 in the substrate 10.

The pin 22 is preferably made of brass for most applications. A coating of solder may also be employed on the pin 22. The coating of solder provides an optional soldered termination where this is found to be desirable. With a coating of solder on pin 22, heat may be applied about the area of the termination by any of several well known and convenient means, e.g., hot air, resistance heating, infrared lamp, wave soldering and hand soldering. The solder then may fill any spaces between the pin 22, the conductor 20 and the plated through termination hole 14. Alternately, solder may be disposed in a small cavity on either the brass pin 22 or the circuit board 10 in the termination hole 14. Additionally, a pin containing predispersed solder may be inserted into a receiving hole of non-conductive material along with two wires so that a wire to wire connection may be made without making electrical connection of the substrate.

The operation of this first embodiment illustrated in FIG. 1 through 4 is illustrated progressively in FIGS. 1, 2 and 3. In FIG. 1, an insulated conductor 16 is shown positioned above and aligned with a termination hole 14 in the substrate 10. The insulated conductor 16 is also preferably axially oriented in what will become its final position. The pin 22 is then placed above the insulated conductor 16 such that the longitudinally extending channel 26 is directly above the conductor 20 and facing in a direction in which the terminated conductor will extend.

The pin 22 is then forced toward and into the termination hole 14 with the insulated conductor 16 in between. As can be seen in FIG. 2, the abrupt edge defined at the intersection of the end 24 and the side of the pin 22, in combination with the edge of the termination hole 14, will shear the unwanted end portion 28 from the insulated conductor 16.

Simultaneously, the insulation 18 about the insulated conductor 16 is also being sheared at the channel side of the pin 22. Because of the longitudinally extending channel 26 in which the conductor 20 will fit, the conductor 20 is not sheared with the insulation at that point. As the pin progresses into the termination hole 14, the shearing of the unwanted end portion 28 and of the insulation 18 is completed and the pin 22 forces the conductor 20 to assume a vertical position in the longitudinally extending channel 26. As this occurs, the unwanted portion 30 of the insulation 18 is forced from the conductor 20. Thus, the conductor 20 is both stripped and positioned as the pin 22 moves downwardly through the termination hole 14.

As can be seen in FIG. 3, once the pin 22 has been fully inserted into the termination hole 14, the insulated conductor 16 has been trimmed through the removal of the unwanted end portion 28, the conductor 20 has been stripped of the unwanted portion 30 of insulation 18 and the conductor 20 has been tightly positioned against the plated-through termination hole 14. Because of the conductive nature of the pin 22, electrical contact is made with the conductor 20 both directly to the plated wall of the termination hole 14 and also through the pin 22 to the plated wall. Finally, a plating of solder on the pin 22 or located in a small cavity on either the pin or the circuit board may be heated to form a solder joint. Electrical contact between the conductor 20 and the plated-through termination hole 14 does not require the use of this solder step. Rather, it is merely additional assurance of system longevity. It should be understood that solder predisposed on a non-conductive pin or receiving hole can cause a useful electrical bond between wire and hole, wire and pin, wire and wires, wires and hole, or wires and pin in addition to creating a node of all components as previously described.

One such wire preparation and termination means which has proven to be very successful is set forth as an example. Naturally, a wide range of sizes may be employed and also as will be seen below, several other configurations are possible. An insulated conductor having a diameter of the stripped conductor equal to 0.0381 cm. (0.15 inches) was terminated. The circuit board employed had a thickness of 0.81 cm. (0.032 inches) and a termination hole ID of 0.079 cm. (0.31 inches). The circuit board was fiberglass reinforced resin and had a plated-through termination hole. The pin employed was of brass having a diameter of 0.081 cm. (0.032 inches) and a length of 0.318 cm. (0.125 inches). Thus, the fit with the circuit board termination hole provided an interference fit of 0.003 cm. (0.001 inches). The longitudinally extending channel had a maximum depth of 0.036 cm. (0.014 inches) and a width of 0.036 cm. (0.014 inches). The bottom of the longitudinally extending channel was substantially semicircular in cross-section.

Turning next to the embodiment of FIG. 5, a pin 32 is illustrated having a longitudinally extending channel forming a segment on a chord in cross section. The longitudinally extending channel 34 is sized to accommodate two conductors when stripped of insulation. The width of the channel 34 is substantially wider than the stripped conductors and is nearly the width of the two insulated conductors 36 and 38 positioned side-by-side. The widths of this channel 34 thereby assures that the stripped conductors will not be sheared off or partially sheared off as the pin 32 is inserted into the circuit board 10. In spite of the additional width of the channel 34, at least one dimension of the final passageway formed when the pin 32 is inserted into the circuit board 10 is small enough to allow passage of only the stripped conductors. In this way, the insulation will be stripped from the conductor and the conductor will form a proper contact as the pin 32 is inserted into the circuit board 10.

Looking next to the embodiment of FIGS. 6 and 7, a pin 40 is disclosed which includes two longitudinally extending channels 42 and 44 located on opposite sides of the pin 40. The function of this two-channelled pin is to provide the stripping and connecting functions without shearing one portion of the conductor 16. As the pin 40 is inserted into the termination hole 14, the conductor 16 will assume a U-shaped configuration extending down each of the channels 42 and 44 and across the bottom of the pin 40. The insulation 18 on the insulated conductor 16 is sheared from the conductor such that a central portion of the conductor extending beneath the pin 40 remains at least partially insulated while the portions of the conductor 20 extending along the channels 42 and 44 are bared for contact with the plated-through termination hole 14. The excess insulation 18 is cut from the upper portion of the conductor as the pin 40 progresses into the termination hole 14.

FIGS. 8, 9 and 10 illustrate yet another embodiment which incorporates the added feature of insuring proper placement of the insulated conductor 16 in relationship to both the termination hole 14 and the pin 46. FIG. 8 illustrates the pin 46 prepared for termination while FIGS. 9 and 10 illustrate the pin 46 in its completed position. The pin 46 defines an abrupt edge for shearing of the insulated conductor 16 by providing a transverse slot 48 through one side thereof. The transverse slot 48 is preferably sized to accommodate the insulated conductor 16 with some interference in order that the insulated conductor 16 will not easily slip from position. Located at the other end of the transverse slot 48 from the shearing abrupt edge is a longitudinally extending channel 50 having a depth substantially equal to that of the conductor 20. This depth is also uniform along the length of the channel 50. The width of the channel 50 may be tapered near the slot 48 to the full width of the insulated conductor 16 to assure that shearing will not occur to the conductor 20 as the pin 46 moves into the circuit board 10. The width of the channel 50 then narrows to substantially the diameter of the conductor 20. As both the width and depth of the channel 50 is substantially the same size as the conductor 20, the conductor 20 is held in place once the pin is properly positioned. The channel 50 again should combine with the circuit board 10 to create an interference fit with the conductor 20 to further insure against extraction of the conductor from the circuit board. Also, the pin 46 may be plated with solder for the purpose of providing a solder connection.

Although the pin of the preferred embodiment has been described as brass, it has been found that ceramic materials as well as plastics are equally successful at shearing insulated copper wire and such constructions are to be considered within the scope of the present invention. Furthermore, when pins which are relatively larger than in the above example are employed, a multiple number of channels both performing as in the embodiment of FIG. 6 and the embodiment of FIG. 1 can be employed for the simultaneous termination of a number of wires using a single pin. Furthermore, if the termination hole 14 has selective contacts on the sides thereof and the pin is of non-conductive material, it may be possible to form multiple contacts which are not electrically connected using the same pin. Thus, a very versatile, simple and easy-to-use system is disclosed for simultaneously trimming, stripping and terminating wires. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A termination assembly for an insulated conductor comprising a circuit board having a termination hole therein with which an insulated conductor is to be terminated;

an elongate pin sized to fit, in interference, in said receiving termination hole, said pin being of generally uniform transverse cross-section along the length thereof and having a first channel extending longitudinally along a side thereof, said first channel having a first cross-sectional dimension smaller than the diameter of the insulated conductor and sized for interference fit with the cross-section of the conductor when stripped of insulation.

2. The termination assembly of claim 1 wherein said longitudinally extending channel extends the full length of said elongate pin.

3. The termination assembly of claim 1 wherein a first end of said longitudinally extending channel includes an abrupt edge for stripping insulation from the insulated conductor when said pin is positioned in said receiving termination hole.

4. The termination assembly of claim 1 further including solder associated with said pin at said longitudinally extending channel to provide a soldered joint when heated.

5. The termination assembly of claim 4 wherein said solder is provided as a thin coating on said pin.

6. The termination assembly of claim 1 wherein said elongate pin further includes a second channel extending longitudinally along a side thereof, said second channel having a first cross-sectional dimension smaller than the diameter of the insulated conductor and substantially equal to the diameter of the conductors stripped of insulation, said first and second longitudinally extending channels being on opposite sides of said elongate pin.

7. The termination assembly of claim 6 wherein said pin is electrically conductive.

8. The termination assembly of claim 7 wherein said pin is brass.

9. A termination assembly for an insulated conductor comprising a circuit board having a termination hole therein with which an insulated conductor is to be terminated;

an elongate pin sized to fit, in interference, in said receiving termination hole, said pin being of generally uniform transverse cross-section along the length thereof, having a first channel extending longitudinally along a side thereof and having an abrupt edge extending transversely on said pin at a side thereof across the body of said pin from said first channel, said abrupt edge being capable of shearing the insulated conductor when the conductor is positioned between said abrupt edge and said receiving termination hole when said pin is forcefully inserted in said termination hole.

10. The termination assembly of claim 9 wherein said abrupt edge is at a first end of said elongate pin.

11. The termination assembly of claim 9 wherein said elongate pin includes a cross-sectional dimension from said channel to said abrupt edge which is at least twice as large as the diameter of the insulated conductor.

12. The termination assembly of claim 9 wherein said elongate pin further includes a transverse slot intermediate the ends of said elongate pin, said abrupt edge being defined at one end of said transverse slot.

13. The termination assembly of claim 12 wherein said transverse slot has a minimum cross-sectional dimension at least as large as the diameter of the insulated conductor.

14. The termination assembly of claim 12 wherein said transverse slot terminates at one end at said longitudinally extending channel.

15. A termination assembly for an insulated conductor, comprising a circuit board having a termination hole therein with which an insulated conductor is to be terminated;

an elongate pin sized to closely fit in said receiving termination hole, said elongate pin being of generally uniform transverse cross-section along the length thereof and having a first channel extending longitudinally along a side thereof, said first channel having a first cross-sectional dimension smaller than the diameter of the insulated conductor and substantially equal to the diameter of the conductor when stripped of insulation such that an interference fit is provided with the conductor when stripped of insulation and terminated with said pin, and an abrupt edge extending transversely on said pin, said abrupt edge being capable of shearing the insulated conductor when the conductor is positioned between said abrupt edge and said receiving termination hole and when said pin is forcefully inserted in the termination hole, said abrupt edge being defined on the opposite side of said elongate pin from said longitudinally extending channel.

16. A method for connecting an insulated conductor to a circuit board having a termination hole therein for receiving the insulated conductor, including the steps of positioning an insulated conductor over a termination hole in a circuit board;

positioning a pin sized to fit in the termination hole over the insulated conductor; and forcing said pin into said termination hole to shear the insulated conductor at one edge of the hole and to strip a portion of the insulation from the remaining portion of the insulated conductor and to position the stripped conductor in a channel running longitudinally along the pin for termination with the circuit board.

17. A method for connecting an insulated conductor to a circuit board having a termination hole therein for receiving the insulated conductor, including the steps of positioning an insulated conductor in a transverse slot on an elongate pin;

placing the pin in the termination hole; and forcing the pin into the termination hole to shear the insulated conductor at one end of the slot and strip a portion of the insulation from the conductor and position the stripped conductor in a channel extending longitudinally along the side of the pin for termination thereof with the circuit board.

18. A method for connecting an insulated conductor to a circuit board having a termination hole therein for receiving the insulated conductor, including the steps of positioning a conductor across the termination hole;

positioning a pin on said insulated conductor; and forcing the pin into the termination hole to strip a portion of the insulation from the conductor and position the conductor into channels extending longitudinally along the pin on opposite sides thereof for connection of the conductor with the circuit board.

* * * * *